US006758210B1

(12) United States Patent
Chandaria

(10) Patent No.: US 6,758,210 B1
(45) Date of Patent: Jul. 6, 2004

(54) FIRELOG GRATE FOR RETAINING FIRE STARTERS

(76) Inventor: Ashok Chandaria, P.O. Box 48020, Nairobi (KE)

( * ) Notice: Subject to any disclaimer, the term of this patent is extended or adjusted under 35 U.S.C. 154(b) by 0 days.

(21) Appl. No.: 10/428,258

(22) Filed: May 1, 2003

Related U.S. Application Data

(63) Continuation-in-part of application No. 10/378,364, filed on Mar. 3, 2003.

(51) Int. Cl.[7] ..... F24B 1/193

(52) U.S. Cl. ..... 126/540; 126/152 B; 126/25 B

(58) Field of Search ..... 126/25 B, 540, 126/9 R, 9 B, 298, 152 B, 541, 512, 542, 152 R; 431/125

(56) References Cited

U.S. PATENT DOCUMENTS 3,682,158 A * 8/1972 Thomas ..... 126/540
3,933,144 A * 1/1976 Bandy ..... 126/25 R
6,199,546 B1 * 3/2001 Freemon ..... 126/25 B
6,371,107 B2 * 4/2002 Chandaria ..... 126/540
2002/0153002 A1 * 10/2002 Lee ..... 126/540

FOREIGN PATENT DOCUMENTS

WO WO 95/10737 * 4/1995

* cited by examiner

*Primary Examiner*—James C. Yeung
(74) *Attorney, Agent, or Firm*—Sand & Sebolt

(57) ABSTRACT

A fireplace grate for retaining fire starters is disclosed. The grate has a front member and a rear member connected together by a transverse bars to form a cradle for holding firelogs. Pairs of legs extend down from the underside of the cradle and firelog retaining projections extend upward from the upper surface of the cradle. The grate includes at least one shelf that is connected to and lies beneath the underside of the cradle. The shelf includes a strut which has a cross-sectional shape configured to interlock with a groove in the bottom surface of a fire starter. When the fire starter is interlocked with the strut, it is held a spaced distance underneath the firelog to be ignited.

13 Claims, 21 Drawing Sheets

FIRELOG GRATE FOR RETAINING FIRE STARTERS

BACKGROUND OF THE INVENTION

1. Technical Field

This invention generally relates to fireplace grates. More particularly, the invention relates to a fireplace grate for use in association with artificial firelogs. Specifically, the invention relates to a fireplace grate that includes an area for supporting fire starter logs and that is additionally configured to burn an artificial firelog in both an aesthetically pleasing and efficient manner.

2. Background Information

Fireplace grates have been used for a long time to support firelogs above the floor of a hearth. The gap between the hearth floor and the grate allows for air to circulate beneath the firelogs and also allows ash to drop away from the burning logs. This assists in maintaining air circulation around the logs and helps prevent the flames from being smothered by the ash. Typically fireplace grates have been manufactured from a number of intersecting iron bars that form a cradle for holding the firelogs. The end bars are bent to form legs for the grate.

Wood logs have traditionally been burned to both generate heat and create ambiance in the room with the fireplace. One of the problems encountered with using wood in a fireplace, however, is that it is fairly difficult to get the wood to burn. Typically, small pieces of wood, known as kindling, are used to start the fire. Larger logs need to be chopped into smaller logs to make kindling and this can be both problematic and time consuming for the homeowner. It has recently become fairly common to use small wax and sawdust based artificial fire starters to aid in igniting the wood logs. Suitable fire starters are of the type such as those sold under the STARTERLOGG brand manufactured by the Conros Corporation of Don Mills, Ontario Canada. Current designs of fireplace grates have not accommodated the introduction of fire starters. The homeowner has to place the fire starters on the bars of the fireplace grate and then stack the wood logs over the fire starter. The homeowner has to be sure to provide space around the fire starter to allow air to circulate or the fire starter will not burn. A match or lighter may be used to ignite the fire starter and the burning fire starter causes the wood logs to catch fire.

Many homes now have natural gas heating and wood burning fireplaces that are no longer used. Recently, however, there has been a movement toward burning artificial firelogs instead of wood logs to create the ambiance of a wood log without the difficulty of starting the fire and the related messy cleanup. The artificial firelogs are made of a mixture of wax and sawdust and they are covered with a paper wrapper that is not only designed as packaging, but is also used as the wick for combustion. The fire may be started by lighting a corner of the paper wrapper, and as the wrapper rapidly burns away from around the firelog, it causes the wax in the firelog to ignite. In order for the artificial firelog to burn easily, an air layer needs to be maintained between the firelog and the paper wrapper. If the paper wrapper contacts the firelog, both the paper and the firelog are slow to ignite and the rate of combustion is greatly slowed down. Traditional fireplace grates do not accommodate the use of artificial firelogs in combination with fire starters inasmuch as the artificial firelog must be placed directly on top of the fire starter. This causes the paper on the bottom of the artificial firelog to be pushed into contact with the log itself, thereby squeezing air from between the firelog and the paper wrapper. Additionally, placement on top of the fire starter tends to smother the flame on the fire starter and hinder the ignition of both the paper wrapper and the artificial log. Additionally, as an artificial firelog reaches the end of its burning capacity, it begins to fall apart, creating a flare-up of the chemicals and materials of which it is composed.

There therefore exists a need in the art for a fireplace grate that allows for the use of a fire starter in conjunction with wood logs or artificial firelogs and that allows for a more efficient combustion of the logs. Furthermore, there exists a need in the art for an improved fireplace grate the assists in controlling the rate of combustion and breakup of artificial firelogs.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
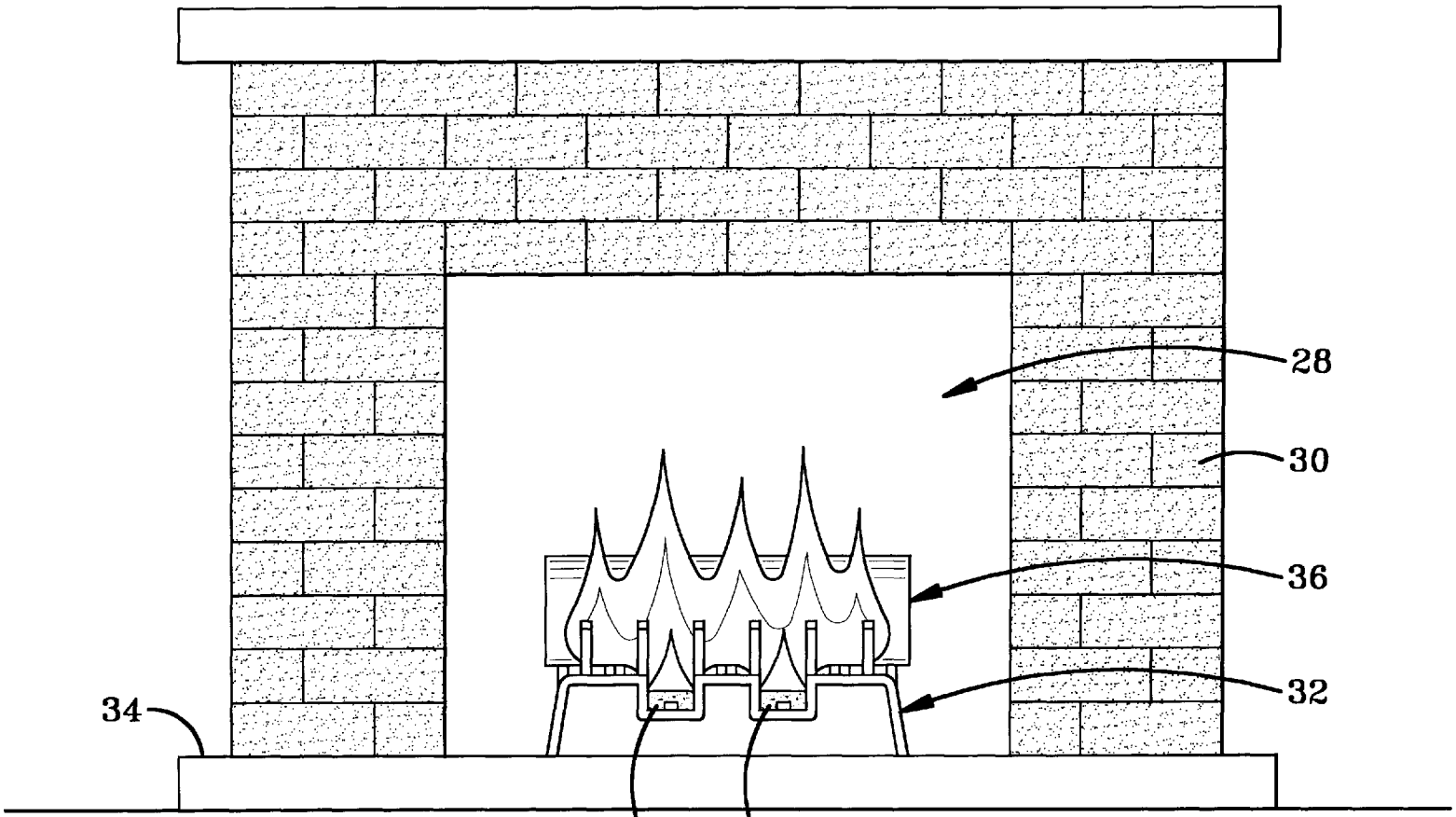
FIG. 1 is a front view of a fireplace grate in accordance with the present invention, the grate being shown as used in a fireplace.

Referring to FIG. 1, there is shown a fireplace or firebox 28 built into a wall 30. A fireplace grate, generally referred to by the number 32, stands on the floor 34 of the fireplace 28. Grate 32 is adapted to support at least one firelog 36 therein. Firelog 36 may be either wood logs or artificial firelogs. Grate 32 is further adapted to hold at least one fire starter 38 beneath logs 36 so as to assist in the ignition of firelogs 36. Fire starter 38 is preferably manufactured from a combination of wax and sawdust.

Figure 2:
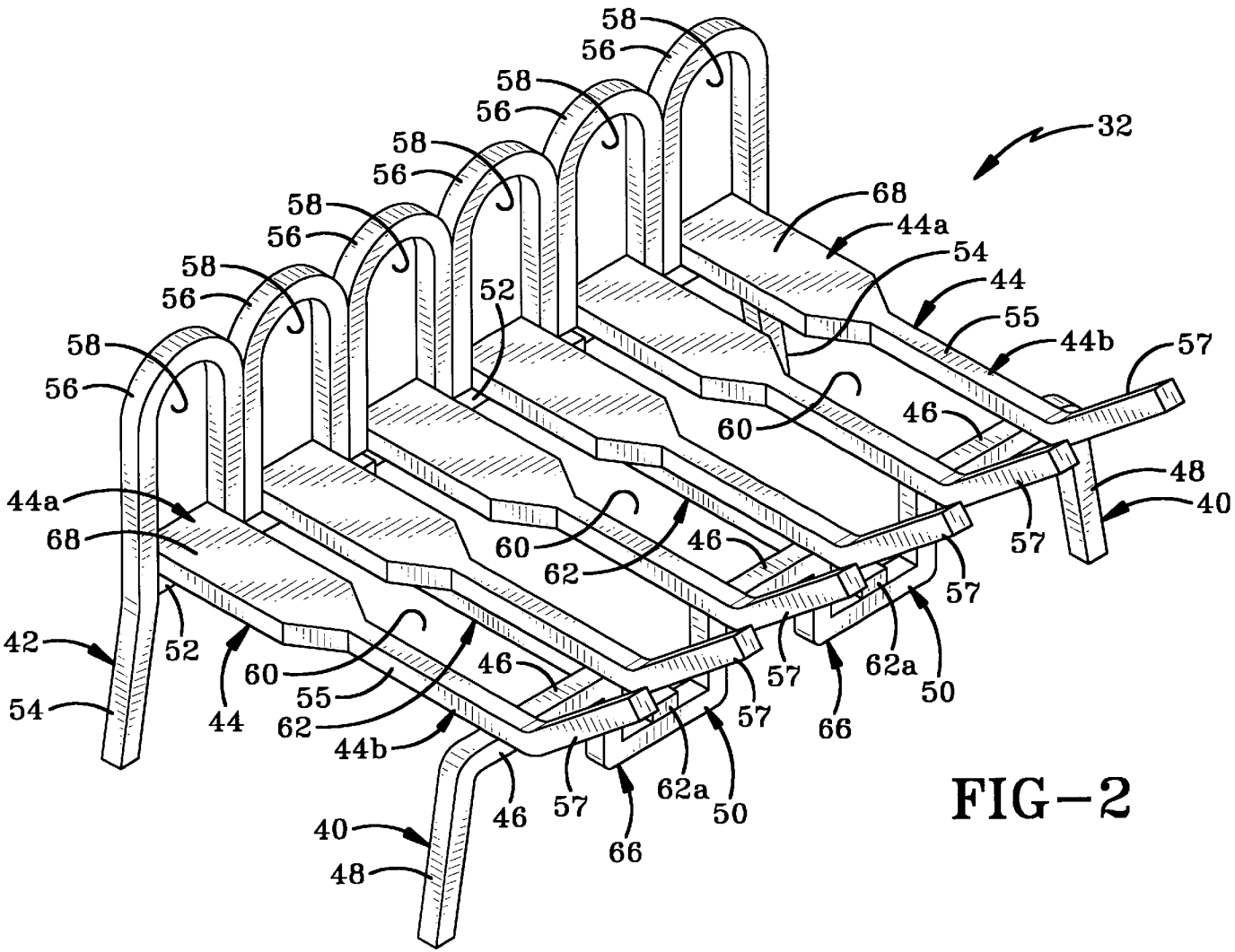
FIG. 2 is a perspective view of the fireplace grate in accordance with the present invention.
Figure 3:
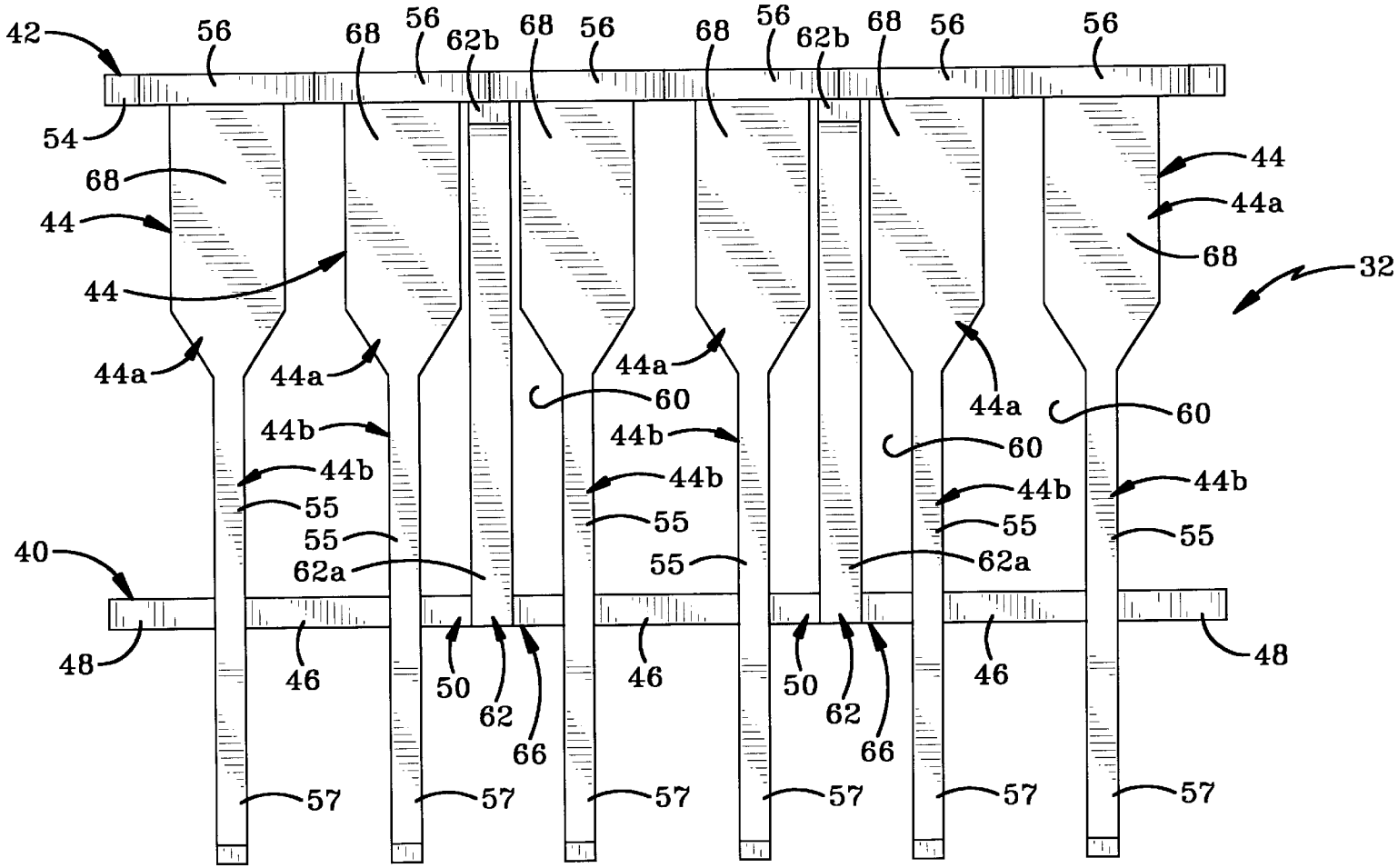
FIG. 3 is a top view of the fireplace grate of FIG. 2.
Figure 3A:
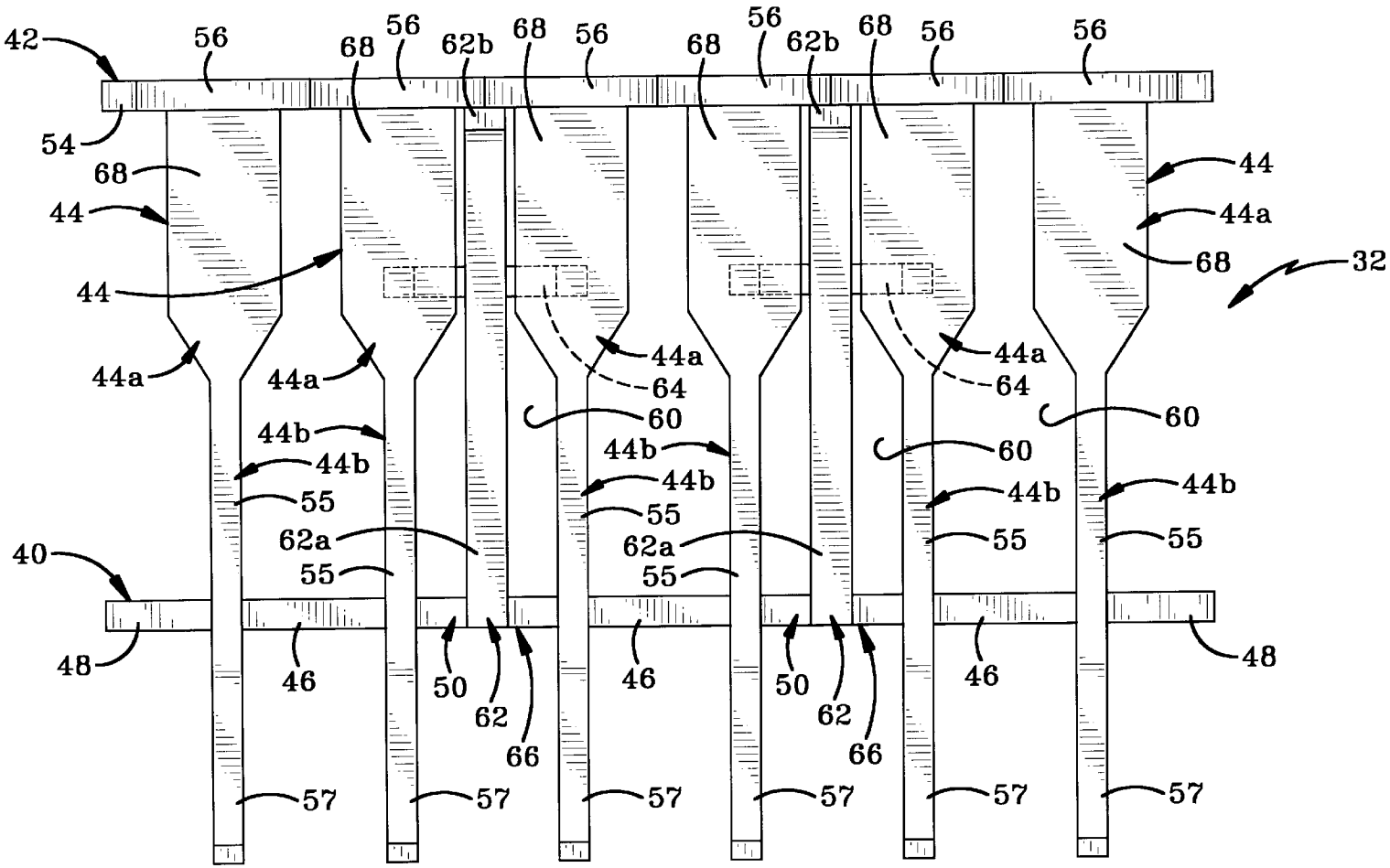
FIG. 3A is a top view of the fireplace grate of FIG. 2, showing an optional bracket attached to the struts.
Figure 4:
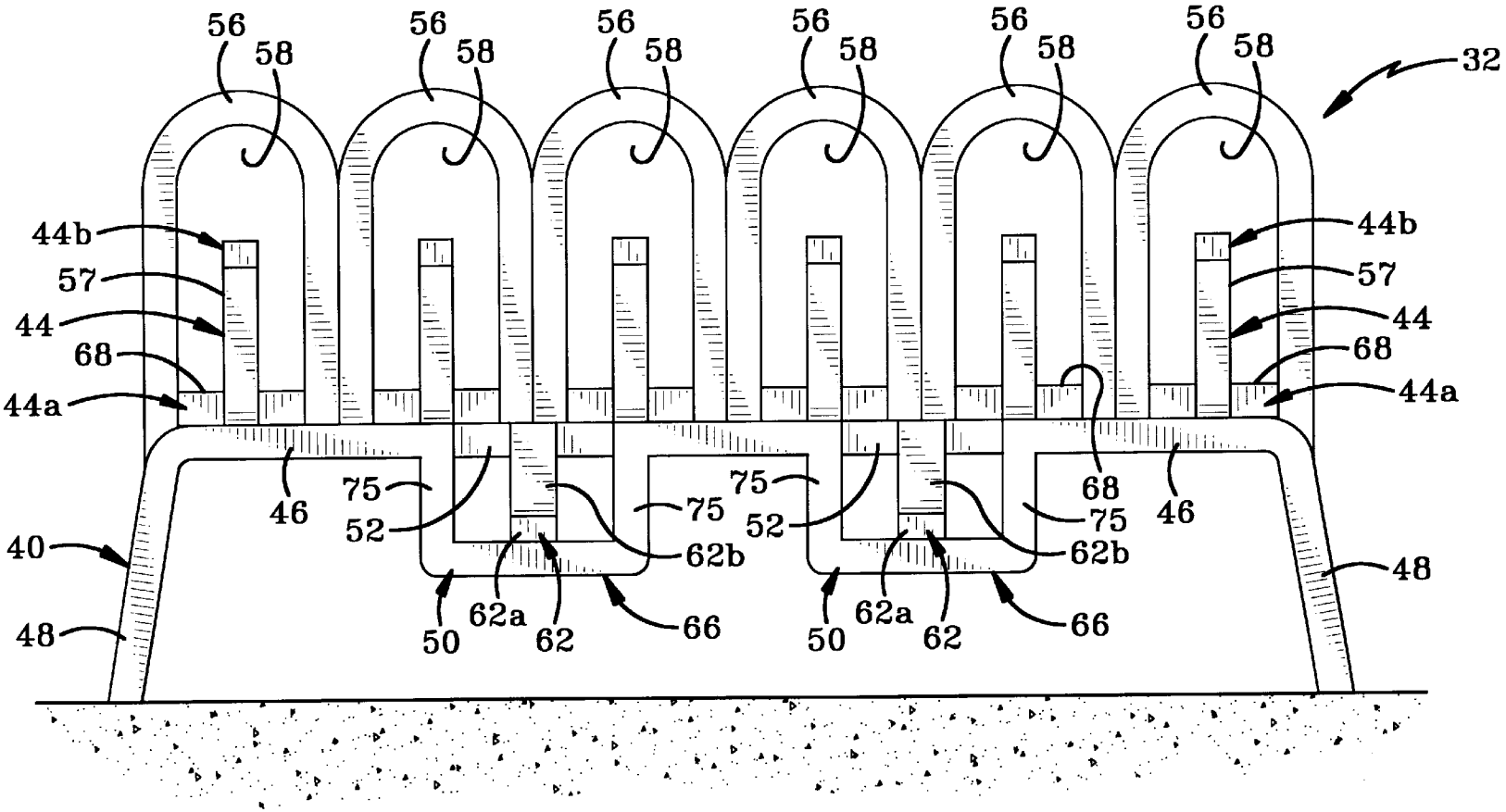
FIG. 4 is a front view of the fireplace grate of FIG. 2.

Referring to FIGS. 2–4, there is shown a first embodiment of grate 32. Grate 32 comprises a front member 40 and a rear member 42 connected together by a plurality of parallel, spaced apart transverse bars 44. Front member 40, rear member 42 and bars 44 may be manufactured as solid metal castings formed of cast iron for example and these components are welded together to form a cradle or platform for supporting firelogs 36 thereon. Alternatively, grate 32 may be manufactured of bent steel stock. As will be understood by those skilled in the art, front and rear members 40, 42 and bars 44 may be connected by any other suitable means such as rivets, nuts and bolts etc. The interconnection between front and rear member 40, 42 and bars 44 provides a stable and strong structure for holding firelogs 36.

Front member 40 is a generally U-shaped member that has an upper section 46 with a leg 48 extending downwardly from either end. Upper section 46 also includes two U-shaped segments 50. U-shaped segments 50 are integrally formed with upper section 46. Segments 50 extend downwardly from upper section 46 in the same direction as legs 48. While the preferred embodiment has two U-shaped segments 50, it will be understood by those skilled in the art that one U-shaped segment or three or more U-shaped segments may be provided in front member 40 without departing from the spirit of the present invention. Furthermore, any other suitably shaped segment—such as a V-shaped segment may be utilized. Additionally, while the legs 48 are shown as extending downwardly from either end of upper section 46, it will be understood by those skilled in the art that legs 48 may be provided at other positions along upper section 46.

Rear member 42 has an upper section 52 with a leg 54 extending downwardly therefrom in a similar matter to front member 40 Extending upwardly from upper section 52 are a series of rounded U-shaped projections 56. Projections 56 are preferably integrally formed with upper section 52 and they are adapted to engage the rear surface of a firelog 36. This assists in preventing firelog 36 from rolling off grate 32. Projections 56 each define a space 58 therein and the spaces 58 allow some air to circulate around firelog 36. While projections 56 are shown to be a rounded U-shape, they may, of course, be manufactured in any other aesthetically pleasing shape. While legs 54 are shown as extending downwardly from either end of upper section 52, it will be understood by those skilled in the art that legs 54 may be provided at other positions along upper section 52.

Figure 5:
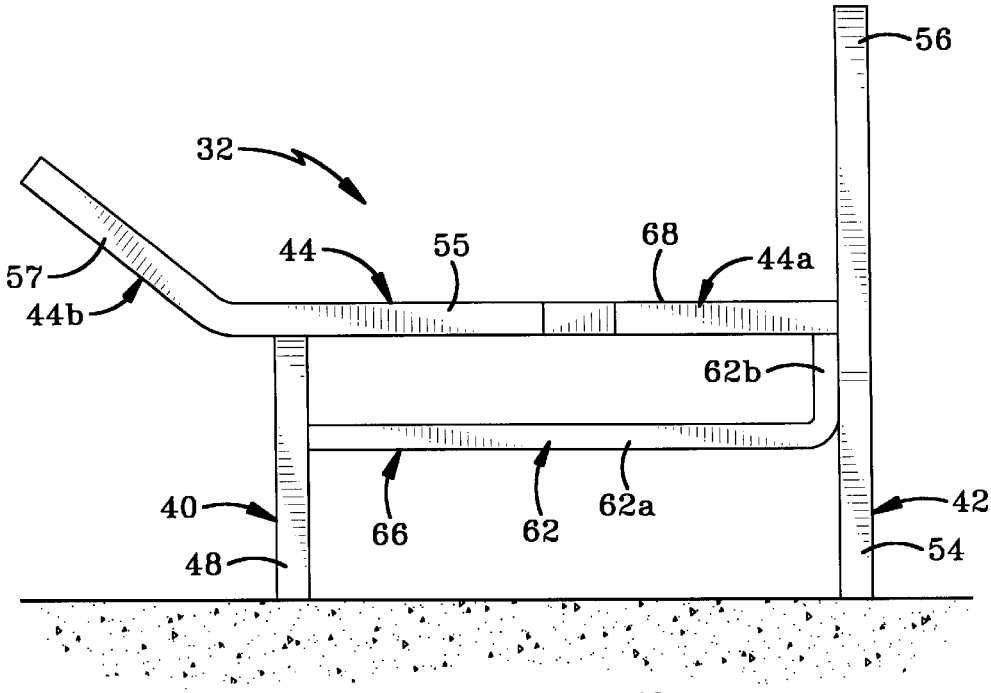
FIG. 5 is a side view of the fireplace grate of FIG. 2.
Figure 11:
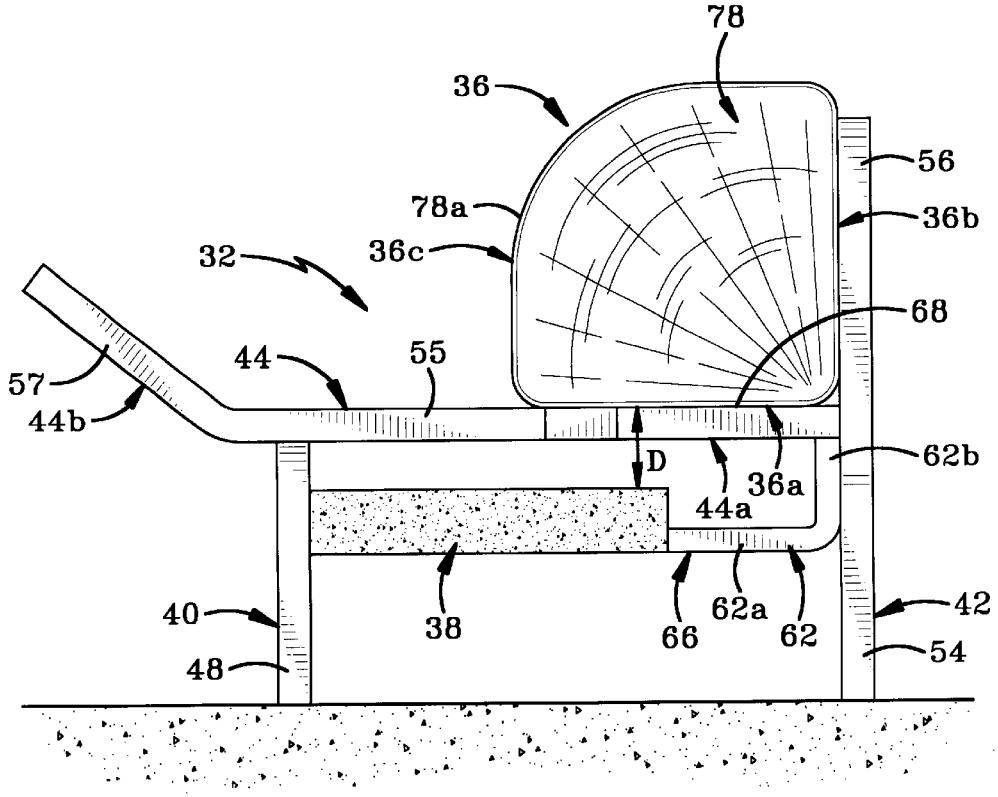
FIG. 11 is a side view through 12—12 of FIG. 10.
Figure 5A:
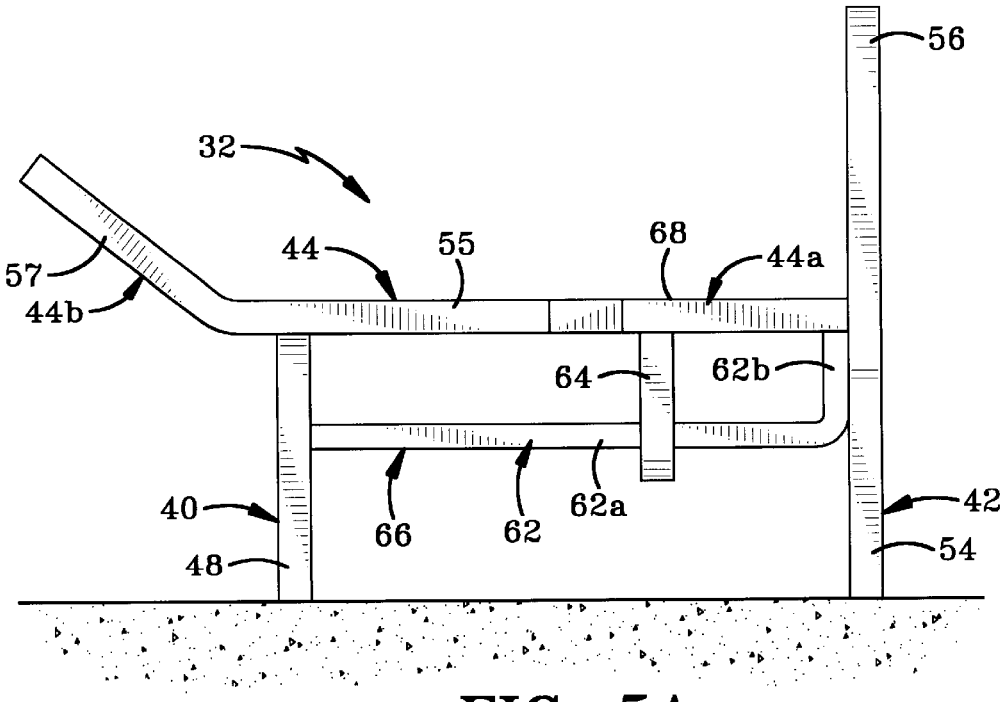
FIG. 5A is a side view of the fireplace grate of FIG. 2 showing the optional bracket connected to the strut.
Figure 6:
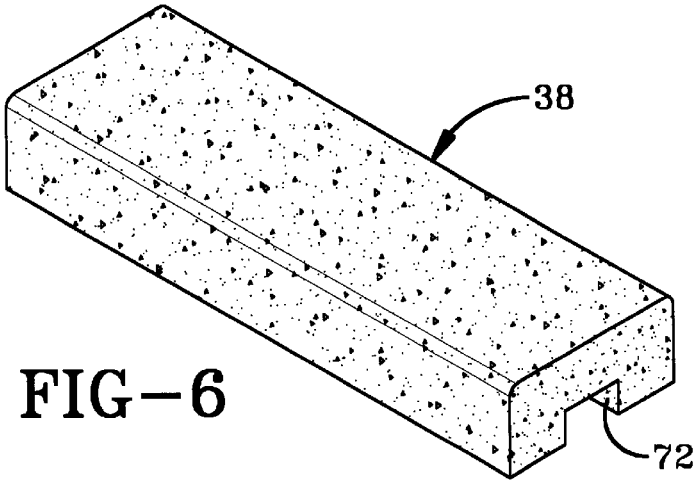
FIG. 6 is a perspective top view of a fire starter to be used in association with the fireplace grate.
Figure 7:
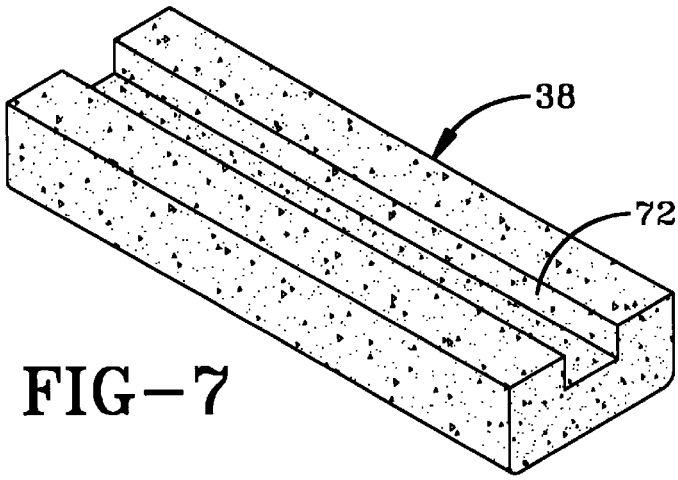
FIG. 7 is a perspective bottom view of the fire starter of FIG. 6.
Figure 8:
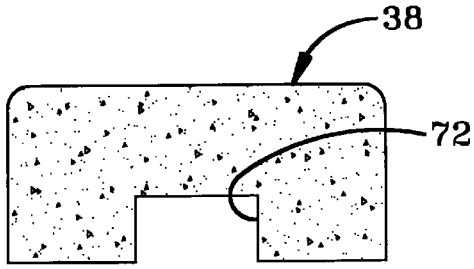
FIG. 8 is a front view of the fire starter of FIG. 6.
Figure 9:
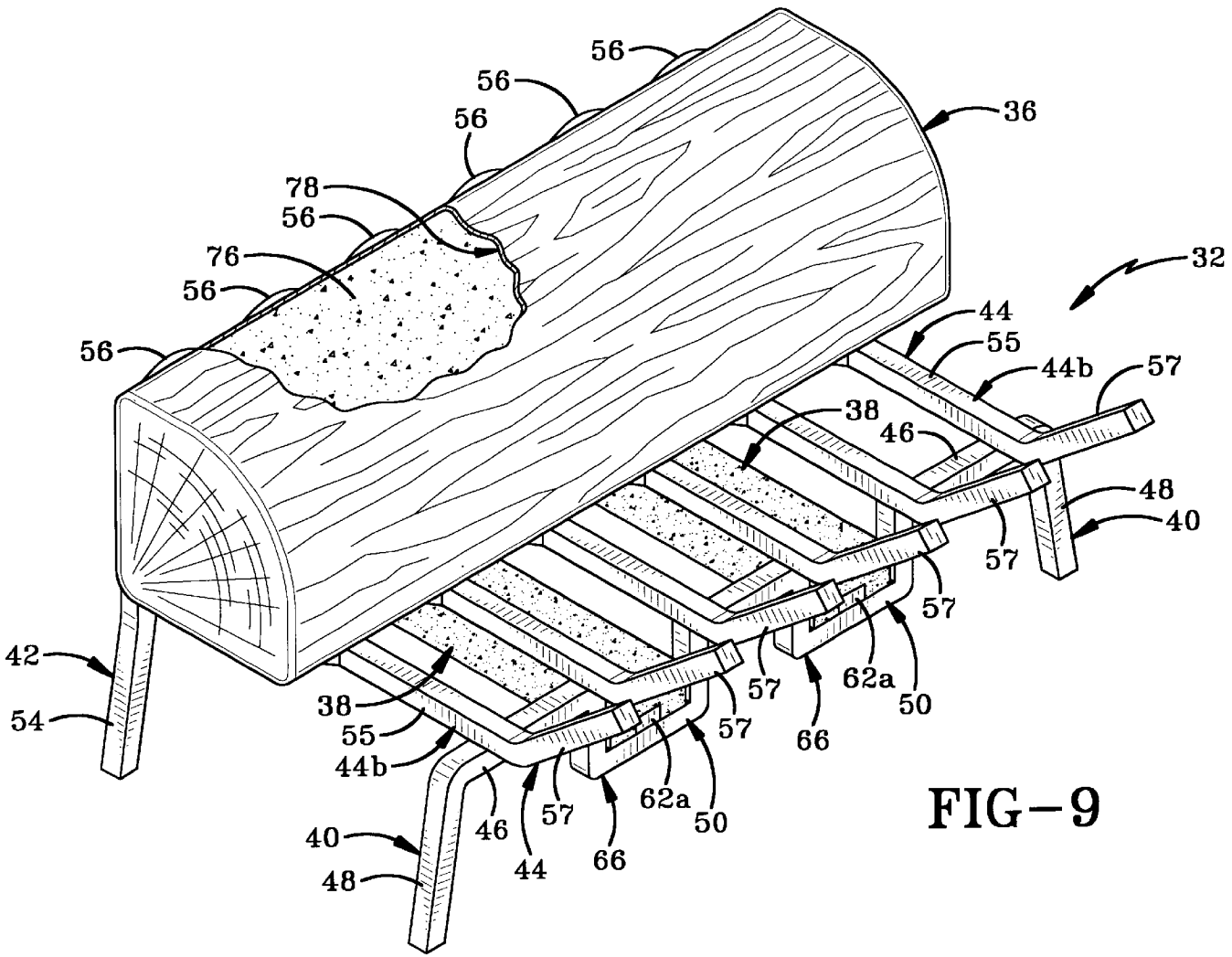
FIG. 9 is a partially cut-away perspective view of the fireplace grate holding an artificial firelog and fire starters therein.
Figure 10:
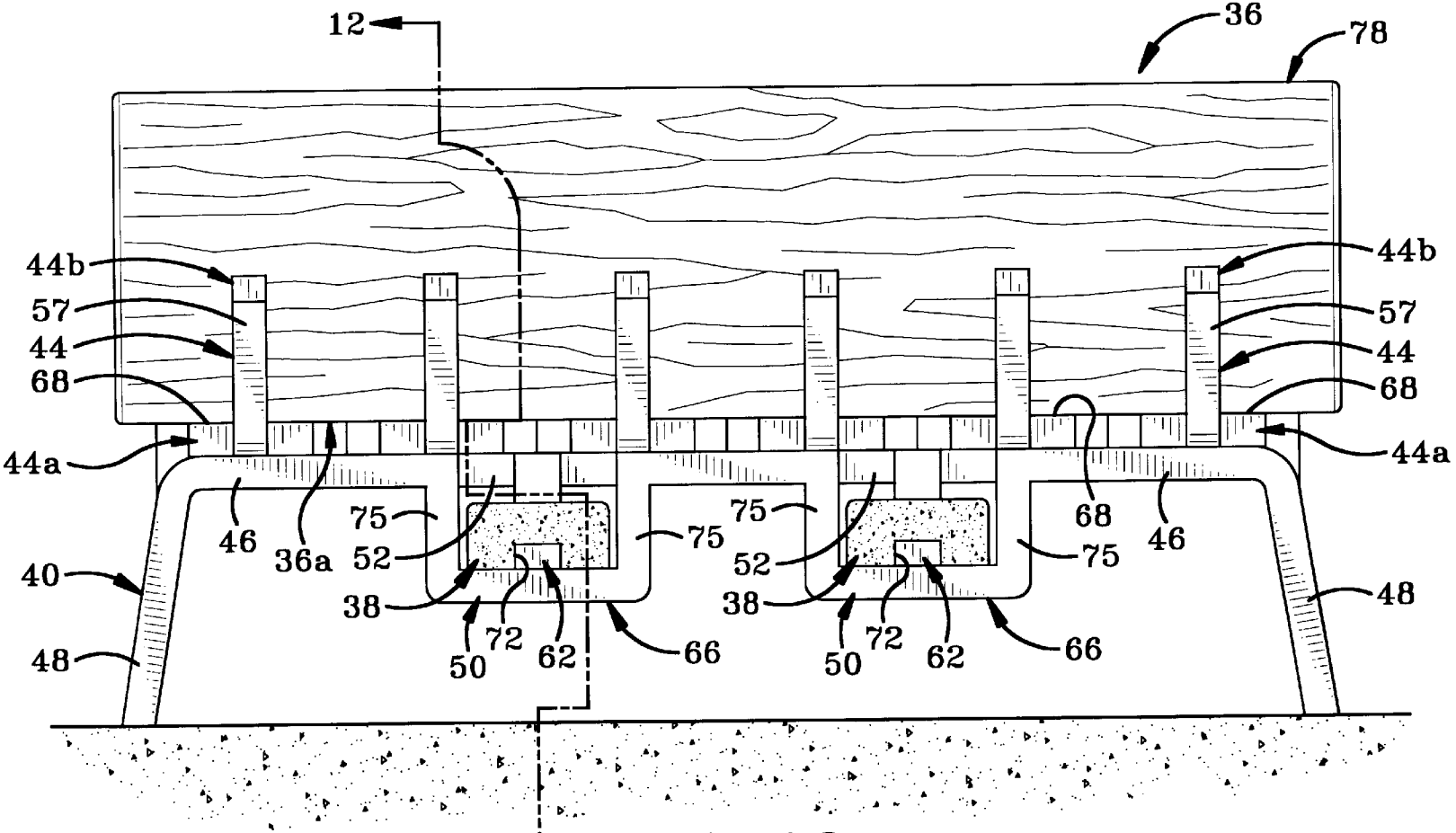
FIG. 10 is a front view of the fireplace grate of FIG. 9.

Transverse bars 44 are spaced at regular intervals between rear member 42 and front member 40. Bars 44 are metal made from cast iron, steel stock or the like. They are generally an open J-shape when viewed from the side (FIG. 5). Bars 44 have a wider flat first section 44*a* and a long narrower second section 44*b*. First section 44*a* rests on upper section 52 of rear member 42 and is preferably welded thereto. Second section 44*b* has a straight portion 55 and an upwardly angled portion 57. Straight portion 55 rests on and is preferably welded to upper section 46 of front member 40. Angled portion 57 extends forwardly of front member 40 and is upwardly angled with respect to front member 40 so that firelogs 36 cannot accidentally roll off grate 32. Bars 44 are positioned in such a manner that a gap 60 is formed between each pair of adjacent bars 44. Gaps 60 allows some air to circulate between bars 44. When assembled together, the rear member 42 with its upwardly extending projections 56, front member 40 and bars 44 with their upwardly angled portions 57 form a cradle or platform onto which a firelog 36 may be placed. While the first section 44*a* of bars 44 is shown to be generally flat and wide and the second section 44*b* is longer and narrower, any other suitable configuration may be used without departing from the spirit of the present invention. Additionally, it will be understood by those skilled in the art that while the legs are shown to be integrally formed as part of front member 40 and rear member 42, the legs could alternatively be mounted on the underside of bars 44 or a combination of bars 44 and front member 40 and/or rear member 42.

Referring to FIGS. 4–8, interposed between pairs of adjacent bars 44 are two generally L-shaped struts 62. Struts 62 include a long leg 62*a* and a shorter leg 62*b*. An end of long leg 62*a* is welded or otherwise connected to U-shaped section 50 of front member 40. The shorter leg 62*b* is welded or otherwise connected to upper section 52 of rear member 42. An additional U-shaped bracket 64 may be welded to two adjacent bars 44 and to the long leg 62*a* of strut at a point spaced away from U-shaped section 50. Bracket 64 provides additional support to strut 62. The combination of the strut 62, U-shaped segment 50 and, if provided, bracket 64, forms a shelf that hangs below the firelog-receiving surface 68 formed by bars 44. Shelves 66 are adapted to receive a fire starter 38 therein.

Fire starter 38 is manufactured from a mixture of wax and sawdust. Starter 38 is formed with a groove 72 therein and the groove is configured to the shape of strut 62. When fire starter 38 is positioned on shelf 66, groove 72 interlocks with strut 62 and is thereby prevented from slipping off shelf 66. Additionally, the upwardly extending sections 75 of U-shaped segment 50 and of bracket 64, if provided, assist in preventing fire starter 38 from sliding off shelf 66. While strut 62 is shown as being generally square in cross-section, it may be of any cross-sectional shape desired. If a differently shaped strut 62 is used, groove 72 is configured to have the same shape so that fire starter 38 and strut 62 are able to interlock.

Figure 12:
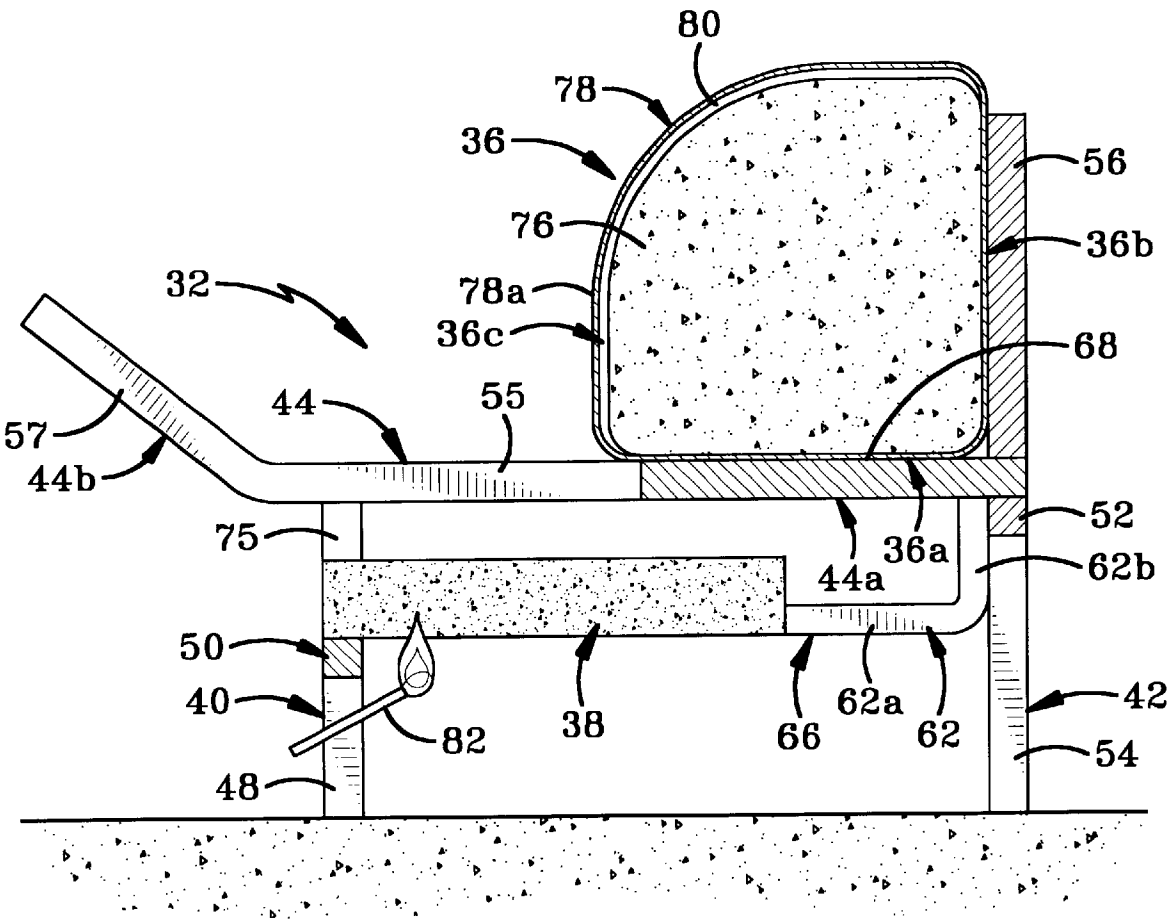
FIG. 12 is a partial cross-sectional side view of the fireplace grate with firelog showing the fire starter being lit.
Figure 13:
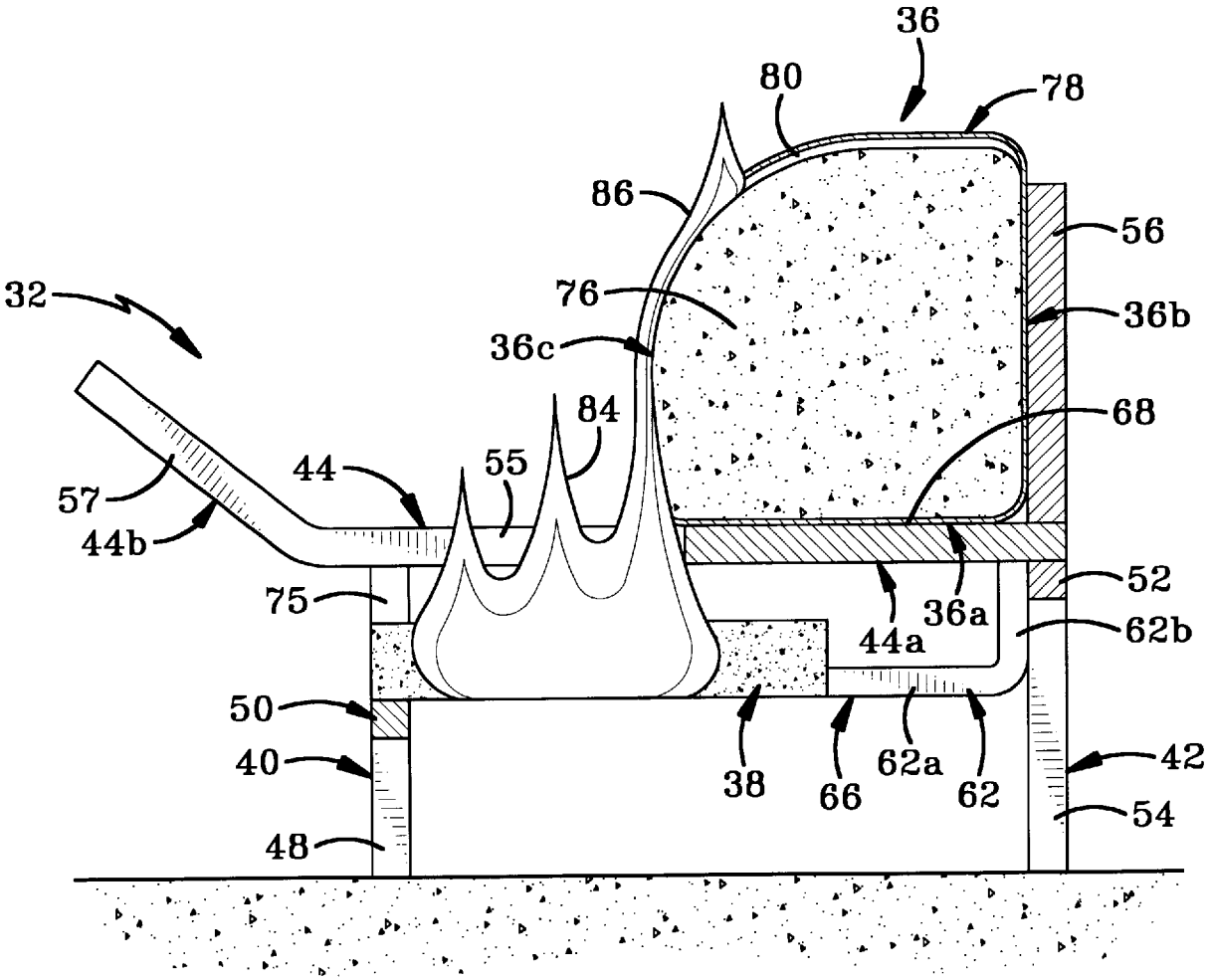
FIG. 13 is a side view of the fireplace grate of FIG. 12 with the flames beginning to consume the front face of the paper wrapper of the artificial firelog.
Figure 14:
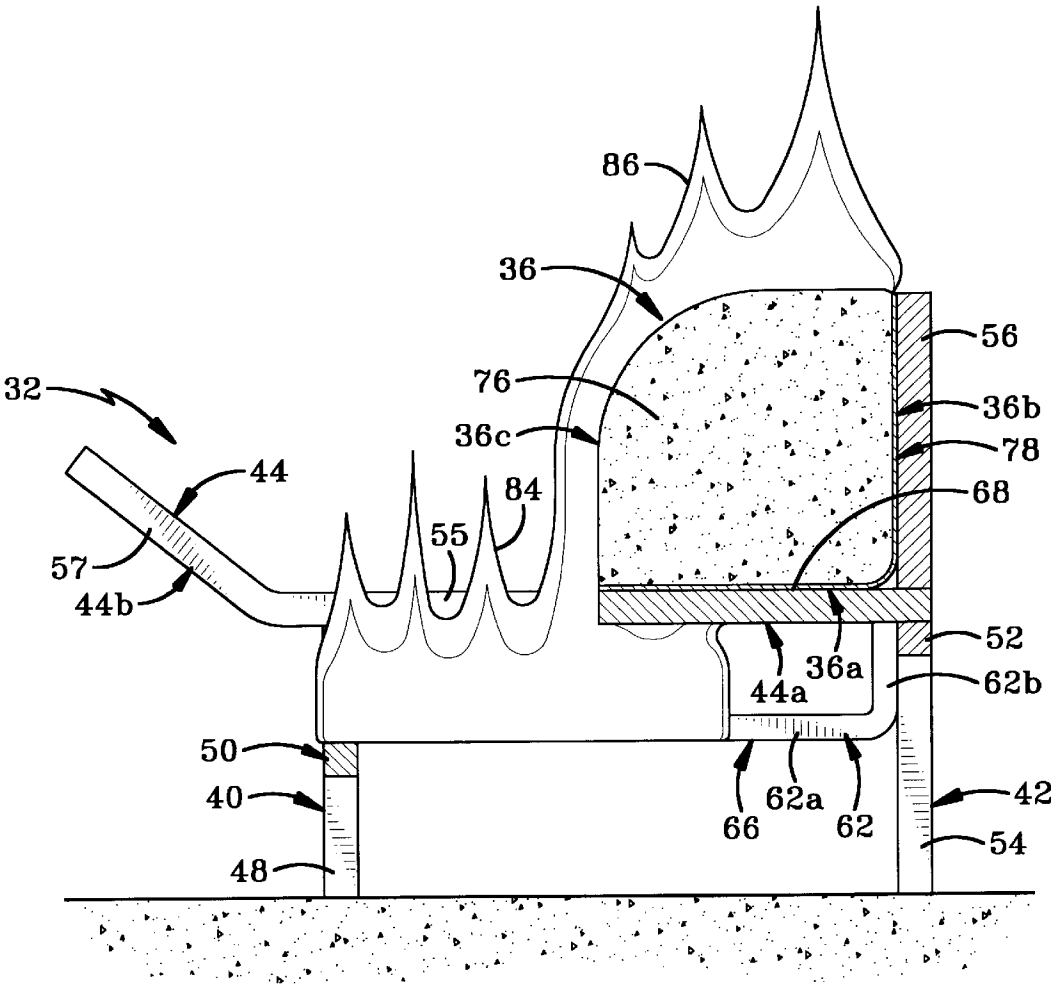
FIG. 14 is a side view of the fireplace grate and firelog with the fire starter fully burning and the front the firelog burning.

Referring to FIGS. 9–14, it can be seen that when a firelog 36 is supported on firelog-receiving surface 68, fire starters 38 may be slid into shelves 66 so that they lie a spaced distance D (FIG. 11) under firelog 36. A wood log or artificial firelog may be positioned on firelog-receiving surface 68. Artificial firelogs are manufactured from a combination of wax, sawdust and other combustible materials. The combustible wax mixture 76 is covered by a paper wrapper 78 and an air layer 80 is formed between mixture 76 and wrapper 78. When firelog 36 is positioned on firelog-receiving surface 68, it is preferably placed so that the bottom surface 36*a* of firelog 36 rests on first sections 44*a* of bars 44. Additionally, rear surface 36*b* of firelog 36 is preferably placed into contact with projections 56 of rear member 42. This causes the paper wrapper 78 to be pushed into contact with the bottom surface 36*a* and rear surface 36*b* of firelog 36, causing the air layer 80 in these areas to be squeezed out from between paper wrapper 80 and mixture 76. A fire lighter, such as a match 82, is used to ignite the combustible material in fire starters 38 (FIG. 12). The flames 84 from fire starters 38 cause the paper wrapper 78 to ignite and begin to burn. The front area 78*a* of paper wrapper 78 tends to catch fire first as air is free to circulate between paper wrapper 78 and the mixture 76 in this area of the firelog 36. The lack of air between the bottom surface 36*a*, rear surface 36*b* and paper wrapper 78 slows down the ignition of the paper wrapper and mixture 76 in those regions of the firelog 36. The flames 84 from fire starter 38 and flames 86 from paper wrapper 78 therefore tend to wrap around the front surface 36*c* of firelog 36 giving an aesthetically pleasing appearance to the burning firelog. Mixture 76 catches fire and the entire firelog 36 burns. As may be seen from FIG. 14, paper wrapper 78 remains at least partially intact around bottom surface 36*a* and rear surface 36*b* of firelog 36 as the first sections 44*a* and projections 56 protect those sections of wrapper 78 from being immediately reached by flames 84 and 86. As such, paper wrapper 78, bottom surface 36*a* and rear surface 36*b* of firelog 36 ignite less quickly than the front surface 36*c* of firelog 36 as a result of their contact with first sections 44*a* and projections 56. As first sections 44*a* and projections 56 retain wrapper 78 adjacent bottom surface 36*a* and rear surface 36*b* of firelog 36, the flame is forced to travel around front surface 36*c* of firelog 36 assuring that the front surface 36*c* is the primary surface which is ignited. This causes firelog 36 to burn significantly slower than if the entire log was engulfed in flames 86. Additionally, the majority of the flames 86 which are viewable by the observer are positioned on the front surface 36*c* of firelog 36 such that the majority of the aesthetics associated with the burning of firelog 36 is viewable by the observer. The grate of the present invention thus assures that not only will firelog 36 burn longer than if the entire firelog were engulfed in flames 86, but the majority of the flames 86 are accurately positioned to assure that the least amount of firelog is consumed while providing flames at the most aesthetically pleasing location. However, eventually, paper wrapper 78 and mixture 76 is completely alight and firelog 36 burns away. First sections 44*a* support the firelog 36 as it burns away and assists in preventing premature disintegration of firelog 36 thereby tending to reduce the hazard caused by the disintegrating firelog 36.

Figure 15:
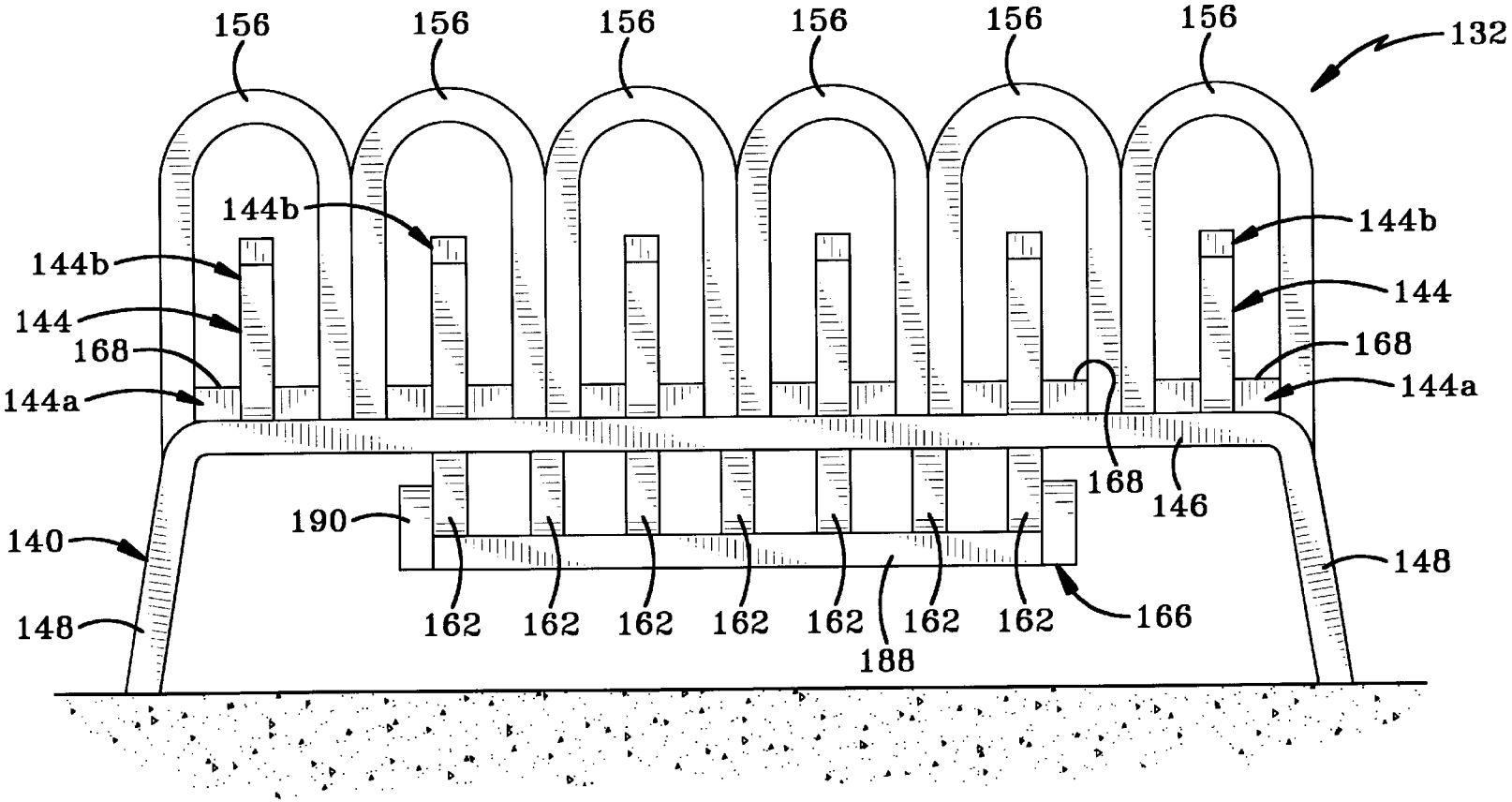
FIG. 15 is a front view of a second embodiment of the fireplace grate in accordance with the present invention.
Figure 16:
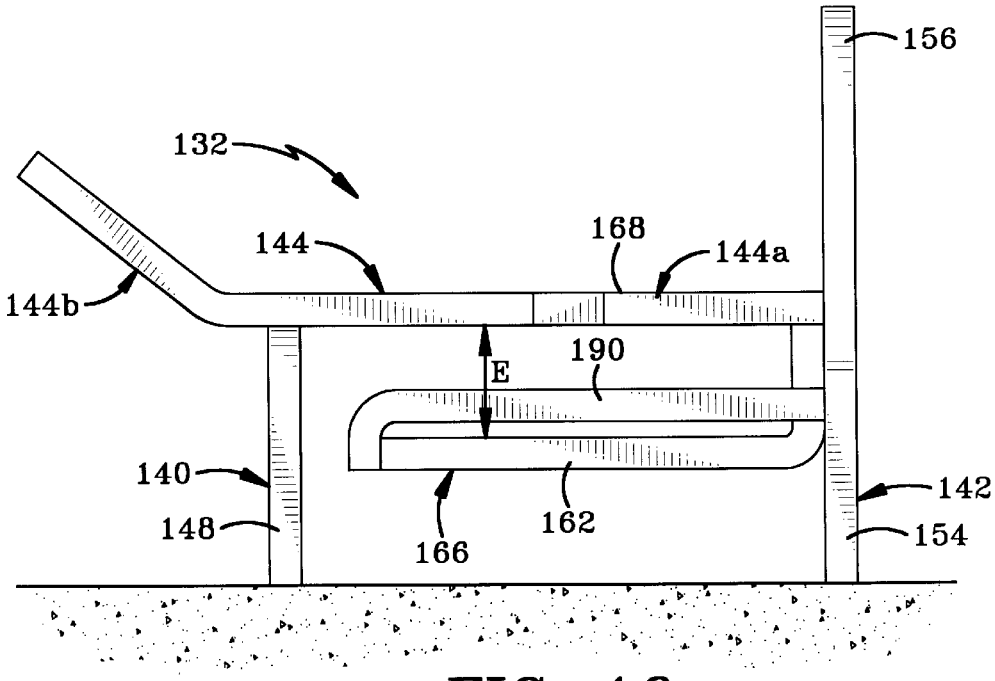
FIG. 16 is a side view of the second embodiment of the fireplace grate shown in FIG. 15.
Figure 17:
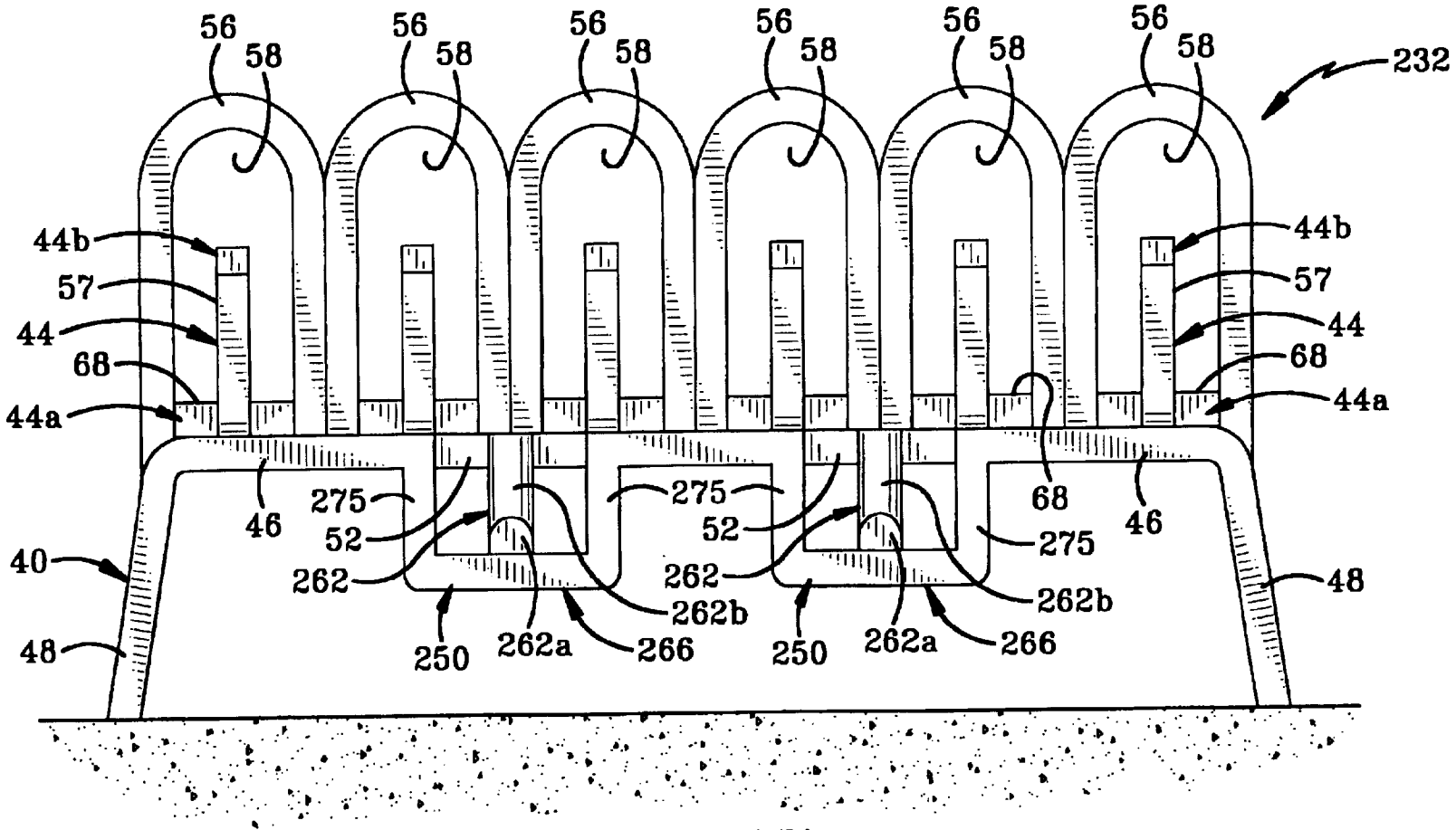
FIG. 17 is a front view of a third embodiment of the fireplace grate showing the rounded struts for receiving a fire starter thereon.
Figure 18:
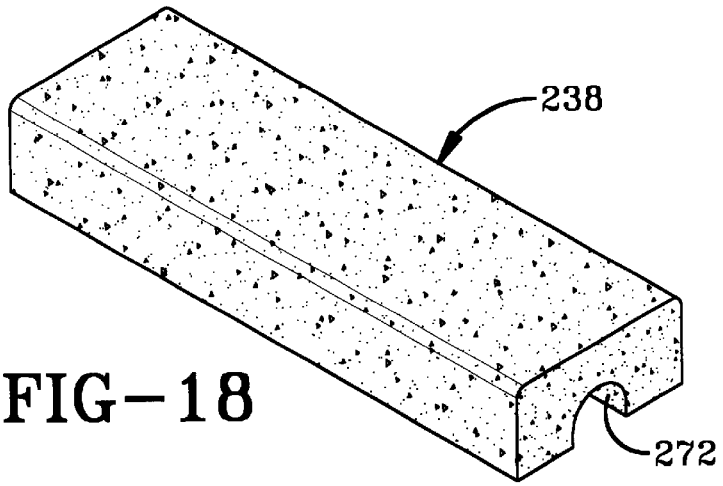
FIG. 18 is a perspective top view of a fire starter to be used in association with the fireplace grate of FIG. 17.
Figure 19:
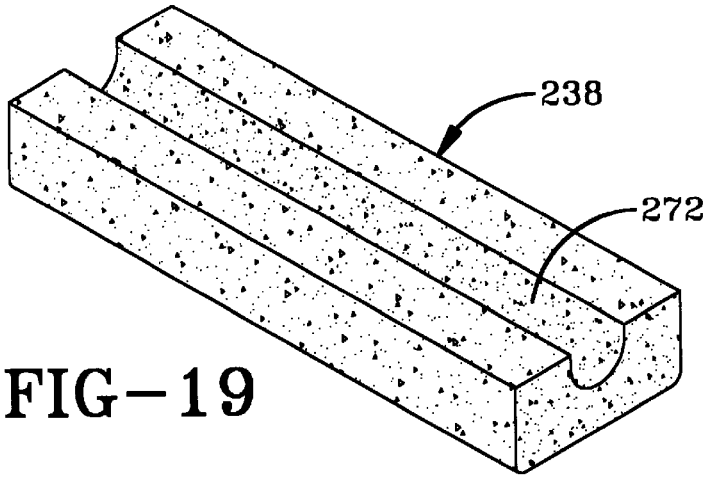
FIG. 19 is a perspective bottom view of the fire starter of FIG. 18.
Figure 20:
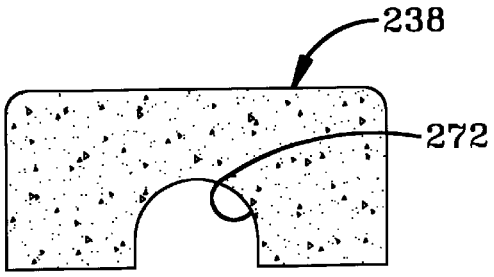
FIG. 20 is a front view of the fire starter of FIG. 18.
Figure 21:
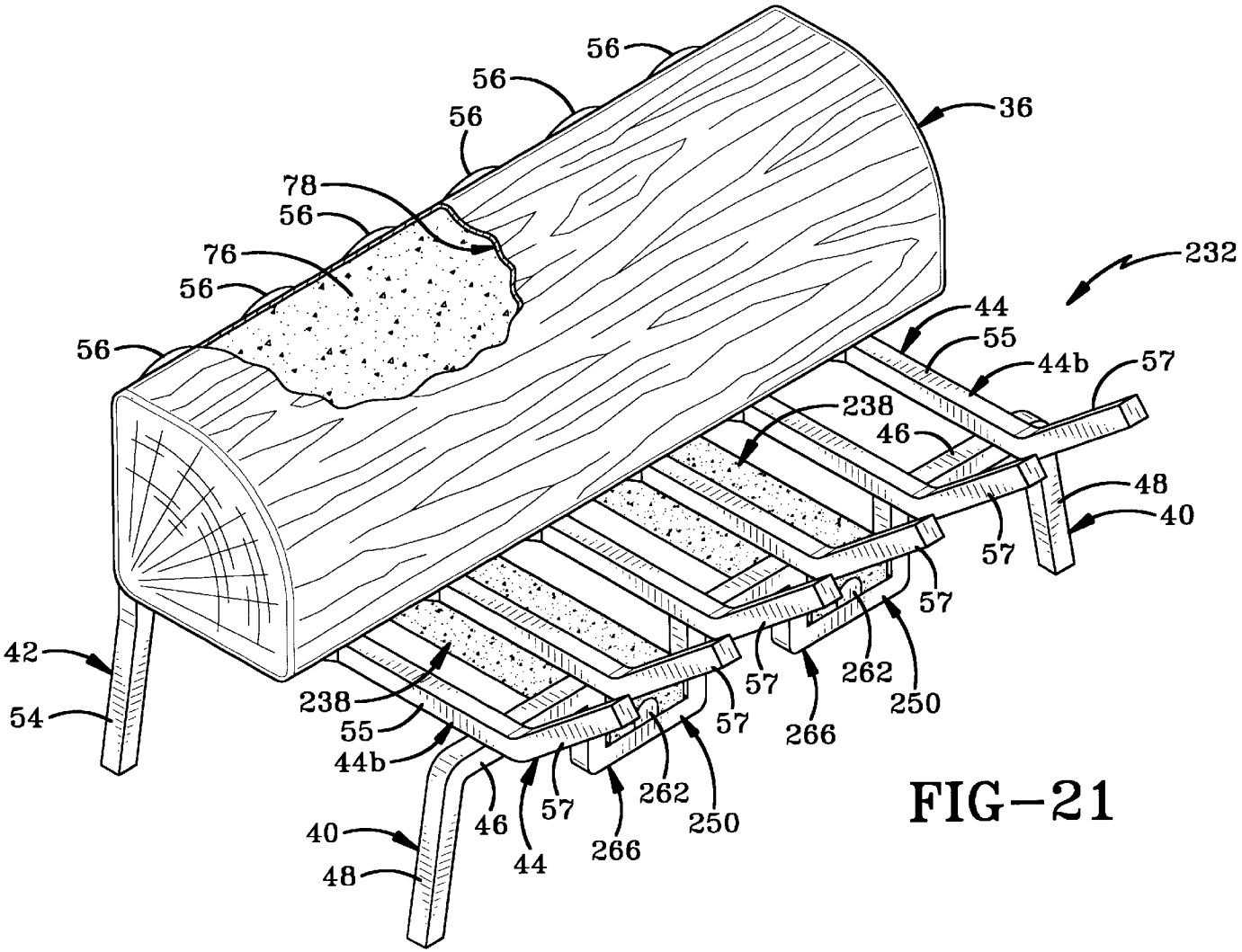
FIG. 21 is a partially cut-away perspective view of the fireplace grate of FIG. 17 showing the grate holding an artificial firelog and fire starters therein.
Figure 22:
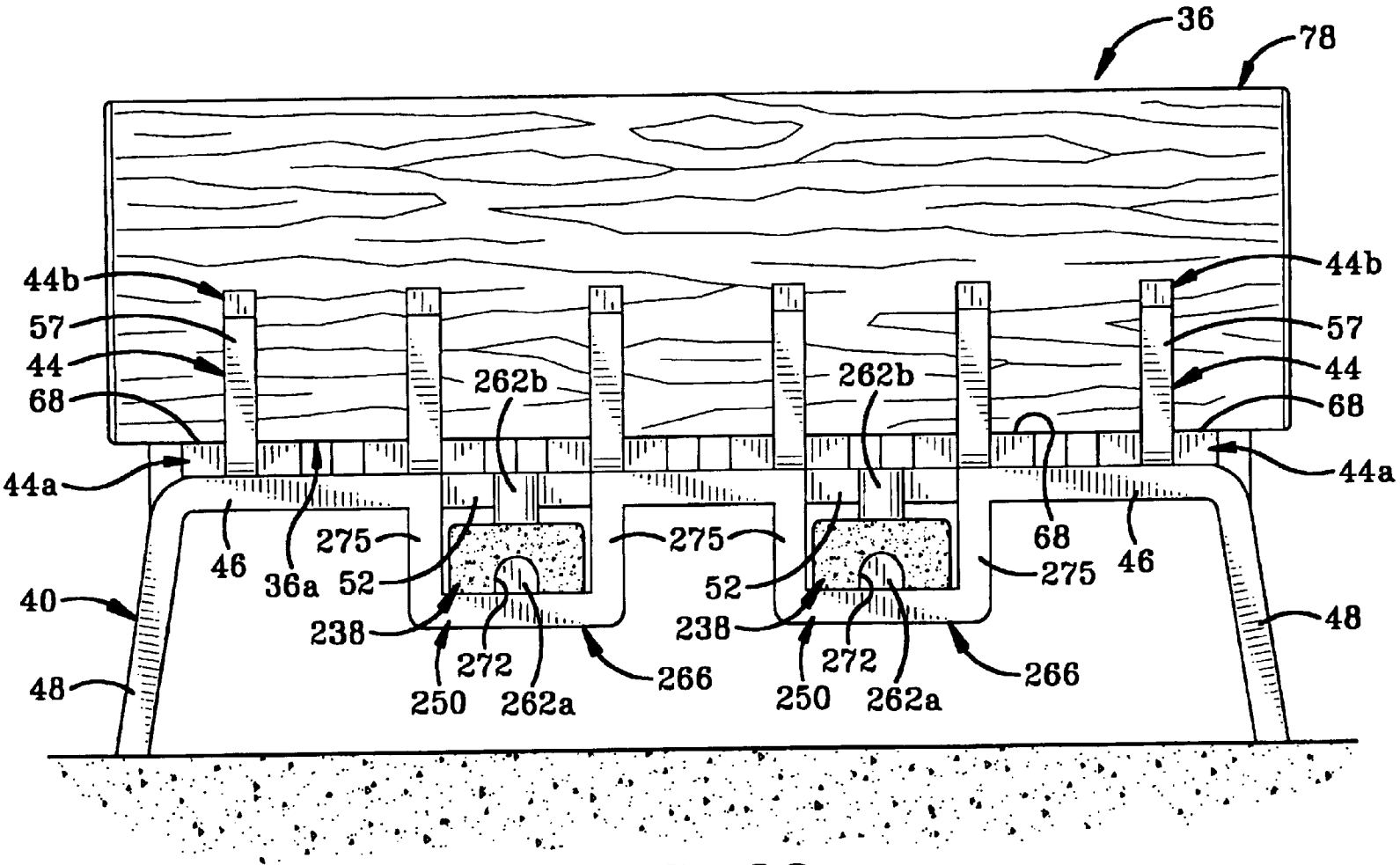
FIG. 22 is a front view of the fireplace grate of FIG. 21.

Referring to FIGS. 15 and 16, a second embodiment of the fireplace grate in accordance with the present invention is shown. In this second embodiment, the fireplace grate is generally referred to by the number 132. In the second embodiment, grate 132 includes a front member 140 and a rear member 142 that are joined together by a plurality of transverse bars 144 in the same manner as the first embodiment. First sections 144*a* of bars 144 form a firelog-receiving surface 168 and second sections 144*b* of bars 144 assist in preventing firelogs (not shown) from rolling off said surface 168. Front member 140 includes a substantially straight upper section 146 with legs 148 extending downwardly from either end thereof. Log-retaining projections 156 extend above firelog-receiving surface 168 while rear legs 154 extend downwardly therefrom. A shelf 166 is disposed below bars 144, a distance E away from firelog-receiving surface 168. Shelf 166 is formed from a plurality of generally L-shaped struts 162 that are connected at one end to the upper section (not shown) of rear member 142. Struts 162 extend forwardly toward front member 140. A front rail 188 connects the front ends of struts 162 together. A side rail 190 is disposed at either end of the plurality of struts 162. Side rails 190 are each connected at one end to rear member 144 and at the other end to front rail 188 This provides additional rigidity to the shelf 166. In use, one or more fire starters (not shown) may be slid onto struts 162. As with the first embodiment, the fire starters define a groove that is configured to the cross-sectional shape of the struts 162. The groove and struts interlock to secure the fire starters thereon and are thereby substantially prevented from slipping off shelf 166. The second embodiment of the invention functions in a similar manner to the first embodiment.

Referring to FIGS. 17–22, there is shown a third embodiment of the fireplace grate in accordance with the present invention. In this embodiment grate 232 comprises a front member 40 and a rear member 42 connected together by a plurality of parallel, spaced apart transverse bars 44. Front member 40, rear member 42 and bars 44 form a cradle or platform for supporting firelogs 36 thereon.

Front member 40 and rear member 42 are substantially the same as those members in the first embodiment of the invention and they function in substantially a similar way. The difference between the two embodiments of the invention is that, interposed between pairs of adjacent bars 44, are two generally L-shaped struts 262. Struts 262 include a long leg 262*a* and a shorter leg 262*b*. An end of long leg 262*a* is welded or otherwise connected to U-shaped section 250 of front member 40. The shorter leg 262*b* is welded or otherwise connected to upper section (not shown) of rear member 42. Strut 262 has an arched cross-section. An additional U-shaped bracket (not shown) may be welded to two adjacent bars 44 and to the long leg 262*a* of strut 62 at a point spaced away from U-shaped section 250. The bracket provides additional support to strut 262. The combination of the strut 262, U-shaped segment 250 and, if provided, the bracket, forms a shelf 266 that hangs below the firelog-receiving surface 68 formed by bars 44. Shelf 266 is adapted to receive a fire starter 238 therein.

As previously described, fire starter 238 is manufactured from a mixture of wax and sawdust. Starter 238 is formed with a groove 272 therein and the groove is configured to the shape of strut 262, i.e. the groove is arched. The shape of groove 272 is preferred inasmuch as there are no inner corners within groove 272 that can be damaged. A damaged corner within groove 272 would tend to reduce the ability of fire starter 238 to interlock with strut 262. Additionally, the arched shape of groove 272 results in stronger fire starter 238 inasmuch as the fire starter 238 will tend less to crack from a point within the groove 272. When fire starter 238 is positioned on shelf 266, groove 272 interlocks with strut 262 and is thereby prevented from slipping off shelf 266. Additionally, the upwardly extending sections 275 of U-shaped segment 250 assist in preventing fire starter 238 from sliding off shelf 266.

Figure 23:
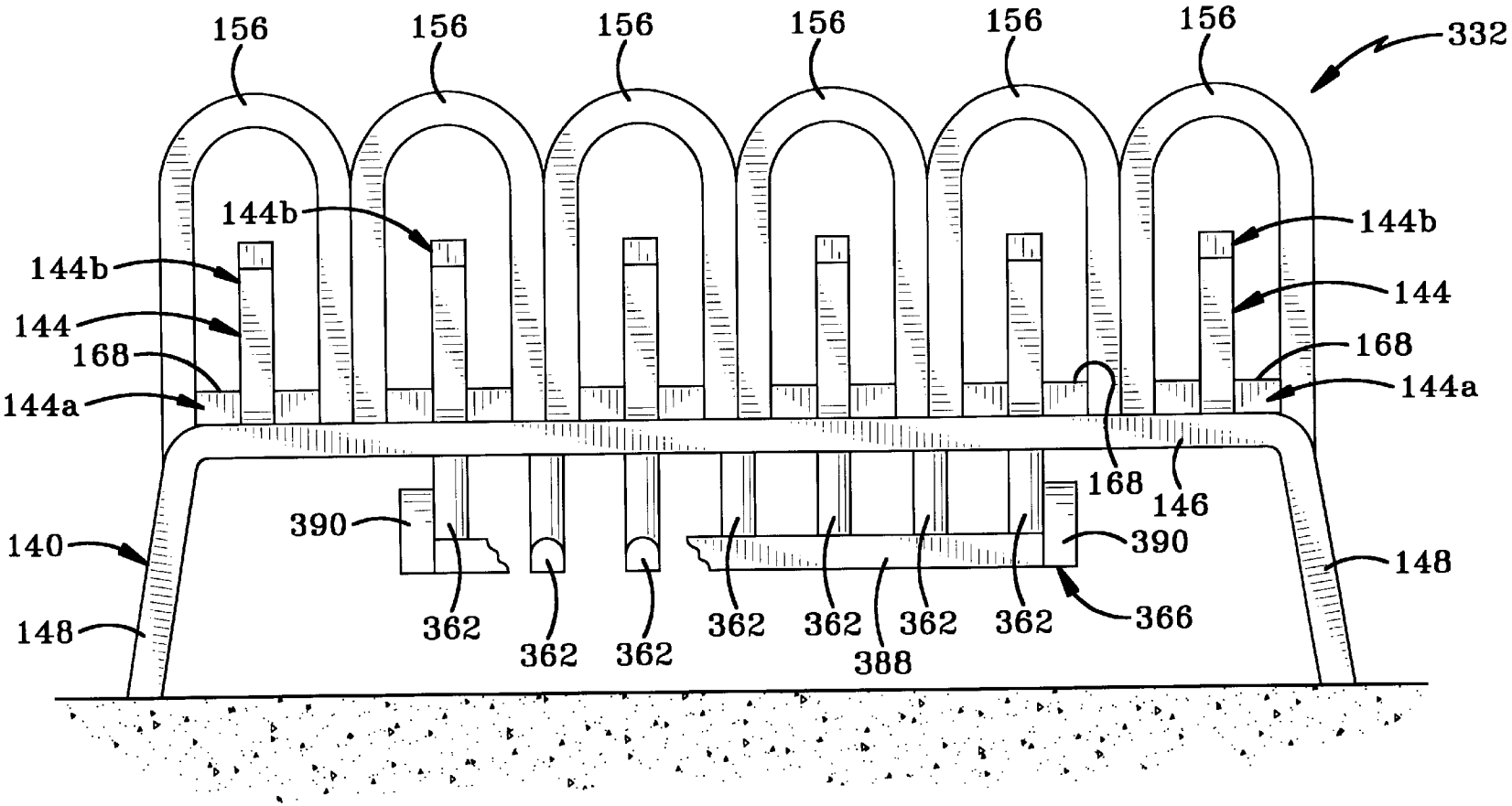
FIG. 23 is a front view of a fourth embodiment of the fireplace grate in accordance with the present invention.
Figure 24:
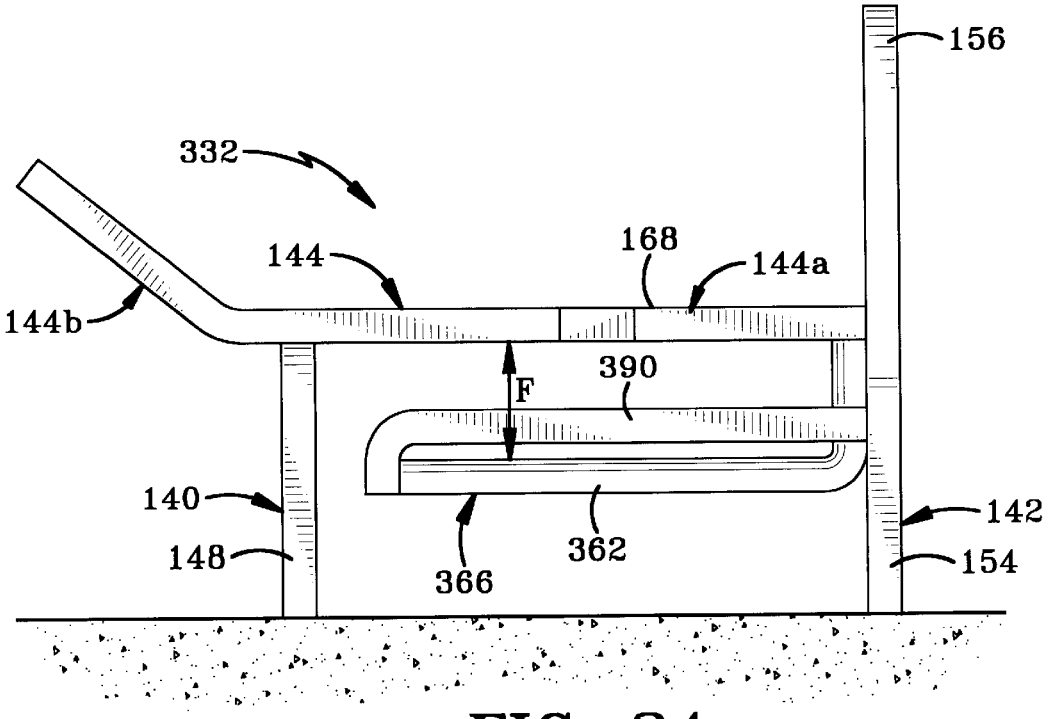
FIG. 24 is a side view of the fourth embodiment of the fireplace grate as shown in FIG. 23.

Referring to FIGS. 23 and 24, there is shown a fourth embodiment of the present invention. This embodiment functions much the same way as the second embodiment of the invention. In this fourth embodiment, the fireplace grate is generally referred to by the number 332. A shelf 366 is disposed below bars 144, a distance F away from firelog-receiving surface 168. Shelf 366 is formed from a plurality of generally L-shaped struts 362 that are connected at one end to the upper section (not shown) of rear member 142. Struts 362 extend forwardly toward front member 140. Each strut 362 is generally arched in cross-section and is adapted to interlock with a fire starter (not shown) that has a complimentarily arched cross-section. A front rail 388 connects the front ends of struts 362 together. A side rail 390 is disposed at either end of the plurality of struts 362. Side rails 390 are each connected at one end to rear member 144 and at the other end to front rail 388 This provides additional rigidity to the shelf 366. In use, one or more fire starters (not shown) may be slid onto struts 362. The grooves on the fire starter and the struts 362 interlock to secure the fire starters thereon and are thereby substantially prevented from slipping off shelf 366.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A firelog grate comprising:

a rear member;

a front member, the front member including a substantially U-shaped segment;

a plurality of spaced apart bars connecting the rear member to the front member, whereby said rear member, front member and bars form a cradle that is adapted to hold a firelog, said cradle including a firelog-receiving surface and an underside;

a plurality of legs extending downwardly from said cradle, said legs being adapted to support the cradle above the floor of a fireplace;

at least one shelf connected to the cradle, said shelf being disposed below the underside of the cradle and being adapted to hold at least one fire starter for igniting the firelog held on the firelog-receiving surface, said shelf comprising at least one substantially L-shaped strut that is connected at a first end to the rear member and at a second end to the U-shaped segment of the front member.

2. A firelog grate as set forth in claim 1, wherein said shelf further comprises at least one bracket disposed between said front member and said rear member, said bracket being connected between a pair of adjacent bars and said strut passes through and is connected to said bracket.

3. A firelog grate as set forth in claim 2, wherein said bracket is substantially U-shaped.

4. A firelog grate comprising:

a rear member;

a front member;

a plurality of spaced apart bars connecting the rear member to the front member, whereby said rear member, front member and bars form a cradle that is adapted to hold a firelog, said cradle including a firelog-receiving surface and an underside;

a plurality of legs extending downwardly from said cradle, said legs being adapted to support the cradle above the floor of a fireplace;

at least one shelf connected to the cradle, said shelf being disposed below the underside of the cradle and being adapted to hold at least one fire starter for igniting the firelog held on the firelog-receiving surface, said shelf comprising at least one substantially L-shaped strut that is connected at a first end to the rear member and extends forwardly toward the front member, said strut being substantially arched in cross-section wherein the strut has a second end and the shelf further comprises:

a front rail connected to the second end of the strut;

a pair of side rails disposed on either side of the strut, said side rails each being connected at one end to the rear member and at the other end to the front rail.

5. In combination, a fireplace grate and a fire starter for use therewith, wherein said combination comprises:

a firelog grate having:

a rear member;

a front member;

a plurality of spaced apart bars connecting the rear member to the front member, whereby said rear member, front member and bars form a cradle that is adapted to hold a firelog, said cradle including a firelog-receiving surface and an underside;

a plurality of legs extending from the underside of said cradle, said legs being adapted to support the cradle above the floor of a fireplace;

at least one shelf connected to the cradle, said shelf being disposed below the underside of the cradle; said shelf having at least one strut that is connected at a first end to the rear member and extends forwardly toward the front member, said strut being substantially arched in cross-section; and a fire starter comprising:

a body molded from a mixture of at least wax and sawdust; said body having a bottom surface, said bottom surface defining a substantially arched groove complementary shaped to the cross-sectional shape of the strut, whereby the fire starter is receivable on the strut and the groove of the fire starter interlocks with the strut thereby holding the fire starter on the strut.

6. The combination of claim 5, wherein the strut is substantially L-shaped when viewed from the side.

7. The combination of claim 6, wherein the strut has a second end and the second end is connected to the front member.

8. The combination of claim 7, wherein the front member includes a shaped segment that extends below the underside of the cradle.

9. The combination of claim 8, wherein the second end of the strut connects to the shaped segment of the front member.

10. The combination of claim 9, wherein the shaped segment is substantially U-shaped.

11. The combination of claim 10, wherein said shelf further comprises at least one bracket disposed between said front member and said rear member, said bracket being connected between a pair of adjacent bars and said strut passing through and being connected to said bracket.

12. The combination of claim 11, wherein said bracket is substantially U-shaped.

13. The combination of claim 5, wherein the strut has a second end and the shelf further comprises:

a front rail connected to the second end of the strut;

a pair of side rails disposed on either side of the strut, said side rails each being connected at one end to the rear member and at the other end to the front rail.

* * * * *